US010674792B2

(12) United States Patent
Mou et al.

(10) Patent No.: US 10,674,792 B2
(45) Date of Patent: Jun. 9, 2020

(54) PNEUMATIC ELASTIC BAND AND INFLATABLE SYSTEM USING SAME

(71) Applicant: Microjet Technology Co., Ltd., Hsinchu (TW)

(72) Inventors: Hao-Jan Mou, Hsinchu (TW); Li-Pang Mo, Hsinchu (TW); Shih-Chang Chen, Hsinchu (TW); Chi-Feng Huang, Hsinchu (TW); Wei-Ming Lee, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 103 days.

(21) Appl. No.: 15/995,549

(22) Filed: Jun. 1, 2018

(65) Prior Publication Data

US 2019/0000188 A1 Jan. 3, 2019

(30) Foreign Application Priority Data

Jul. 3, 2017 (TW) ..... 106122228 A

(51) Int. Cl.

| | |
|---|---|
| ***A43C 9/00*** | (2006.01) |
| ***F04B 45/027*** | (2006.01) |
| ***A43C 11/00*** | (2006.01) |
| ***A43C 11/22*** | (2006.01) |

(52) U.S. Cl.

CPC ..... *A43C 9/00* (2013.01); *A43C 11/008* (2013.01); *A43C 11/22* (2013.01); *F04B 45/027* (2013.01)

(58) Field of Classification Search

CPC ..... A43C 9/00; A43C 11/008; A43C 11/20; F04B 45/027; F04B 45/20

See application file for complete search history.

(56) References Cited

U.S. PATENT DOCUMENTS 3,664,043 A * 5/1972 Polumbus, Jr. ..... A43B 5/0407 36/71
4,361,969 A * 12/1982 Vermonet ..... A43B 13/203 36/29

FOREIGN PATENT DOCUMENTS

CN 106723660 A 5/2017
TW 200901908 A 1/2009

* cited by examiner

*Primary Examiner* — Robert Sandy
(74) *Attorney, Agent, or Firm* — Birch, Stewart, Kolasch & Birch, LLP

(57) ABSTRACT

A pneumatic elastic band includes an outer portion, an inflatable portion and a nozzle. The outer portion has a strip-shaped structure with elasticity. The inflatable portion includes a plurality of expansion portions and a plurality of communication portions. Each of the communication portions is connected between two of the expansion portions adjacent to each other for defining a plurality of gaps. The nozzle is disposed on a surface of the outer portion and communicated with the inflatable portion. When a gas is guided into the inflatable portion through the nozzle, the plurality of expansion portions of the inflatable portion are inflated to fill the gaps and make the inflatable portion contract inwardly, so that the outer portion contracts inwardly and deforms, wherein when the gas is guided out of the inflatable portion, the inflatable portion is deflated and loosened to return to an uninflated state to loosen the shoe.

12 Claims, 15 Drawing Sheets

PNEUMATIC ELASTIC BAND AND INFLATABLE SYSTEM USING SAME

CROSS-REFERENCE TO RELATED APPLICATION

This application claims priority from Taiwan Patent Application No. 106122228, filed on Jul. 3, 2017, the entire contents of which are incorporated herein by reference for all purposes.

FIELD OF THE INVENTION

The present disclosure relates to a pneumatic elastic band and an inflatable system using the same, and more particularly to a pneumatic elastic band which is inflatable, and an inflatable system using such pneumatic elastic band.

BACKGROUND OF THE INVENTION

Generally, normal shoelaces are used in most shoes as a means of loosening, tying and fixing the shoes on the feet. However, the shoes with shoelaces have many problems in wearing. For example, when the shoelaces are loosened while moving, they have to be retied, resulting in inconvenience and waste of time. In addition, there is also potential danger of wearing shoes with normal shoelaces. For example, when the shoelaces are accidentally loosened, other people may trip over it, or the shoelaces may be involved in the gap of an escalator, a bicycle chain or a motorcycle pin, which may cause accidents.

When wearing shoe types having normal shoelaces, the degree of looseness and tightness of normal shoelaces is not easy to control. It takes a longer time to adjust, and it is easy to produce the situation of too tight or too loose, thereby causing the discomfort of the user during wearing. There are even doubts about occurring dangers. And when the normal shoelaces are loosened, it is necessary to loosen part of the shoelaces that are penetrated through each shoelace hole so as to allow the user to wear or take off the shoes, in which it often causes time loss and is extremely inconvenient to the user.

Therefore, how to develop a pneumatic elastic band that can solve the drawbacks in prior arts, be rapidly tightened with safety and convenience and can stably cover and fix the feet, is substantially the urgent problem that is needed to be solved right now.

SUMMARY OF THE INVENTION

The main object of the present disclosure provides a pneumatic elastic band that can solve the drawbacks in prior arts. The pneumatic elastic band can be rapidly tightened with safety and convenience and can stably cover and fix the feet.

In accordance with an aspect of the present disclosure, there is provided a pneumatic elastic band. The pneumatic elastic band comprises an outer portion, an inflatable portion and a nozzle. The outer portion has a strip-shaped structure with elasticity. The inflatable portion comprises a plurality of expansion portions and a plurality of communication portions. Each of the communication portions is connected between two adjacent expansion portions, so that a plurality of gaps are defined. The nozzle is disposed on a surface of the outer portion and communicated with the inflatable portion. When a gas is guided into the inflatable portion through the nozzle, the plurality of expansion portions of the inflatable portion are inflated to fill the plurality of gaps and make the inflatable portion contract inwardly, so that the outer portion correspondingly contracts and deforms. When the gas is guided out of the inflatable portion through the nozzle, the inflatable portion is deflated and loosened to return to an uninflated state.

In accordance with another aspect of the present disclosure, there is provided an inflatable system. The inflatable system comprises at least one pneumatic elastic band, a gas pump, a switch and a control module. The at least one pneumatic elastic band comprises an outer portion, an inflatable portion and a nozzle. The outer portion has a strip-shaped structure with elasticity. The inflatable portion comprises a plurality of expansion portions and a plurality of communication portions. Each of the communication portions is connected between two adjacent expansion portions, so that a plurality of gaps are defined. The nozzle is disposed on a surface of the outer portion and communicated with the inflatable portion. When the gas is guided into the inflatable portion through the nozzle, the plurality of expansion portions of the inflatable portion are inflated to fill the plurality of gaps and make the inflatable portion contract inwardly, so that the outer portion correspondingly contracts and deforms. When the gas is guided out of the inflatable portion through the nozzle, the inflatable portion is deflated and loosened to return to the uninflated state. The gas pump is in communication with the nozzle. The control module is electrically connected with the gas pump and the switch. When the switch is switched on, the switch sends an enable signal to the control module, the control module drives the gas pump to guide the gas from an exterior of the at least one pneumatic elastic band into the inflatable portion according to the enable signal, so that the at least one pneumatic elastic band is inflated and contracts inwardly. When the switch is switched off, the switch sends a pressure relief signal to the control module, the control module guides the gas from the inflatable portion to the exterior of the pneumatic elastic band according to the pressure relief signal, so that the at least one pneumatic elastic band is deflated and loosened to return to the uninflated state.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
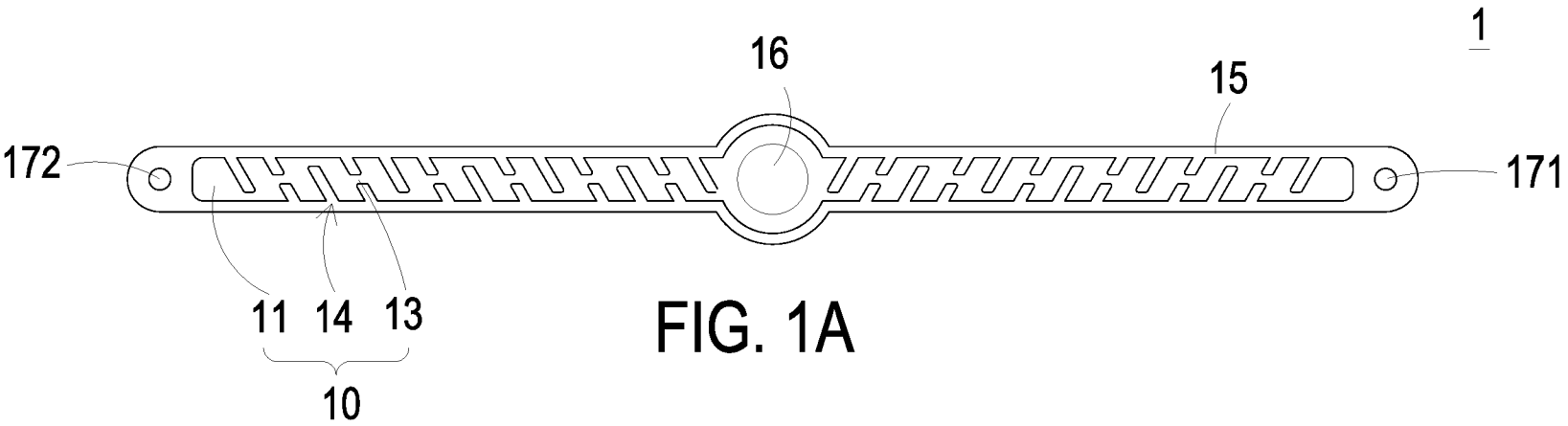
FIG. 1A is a schematic perspective view illustrating a pneumatic elastic band according to an embodiment of the present disclosure.
Figure 1B:
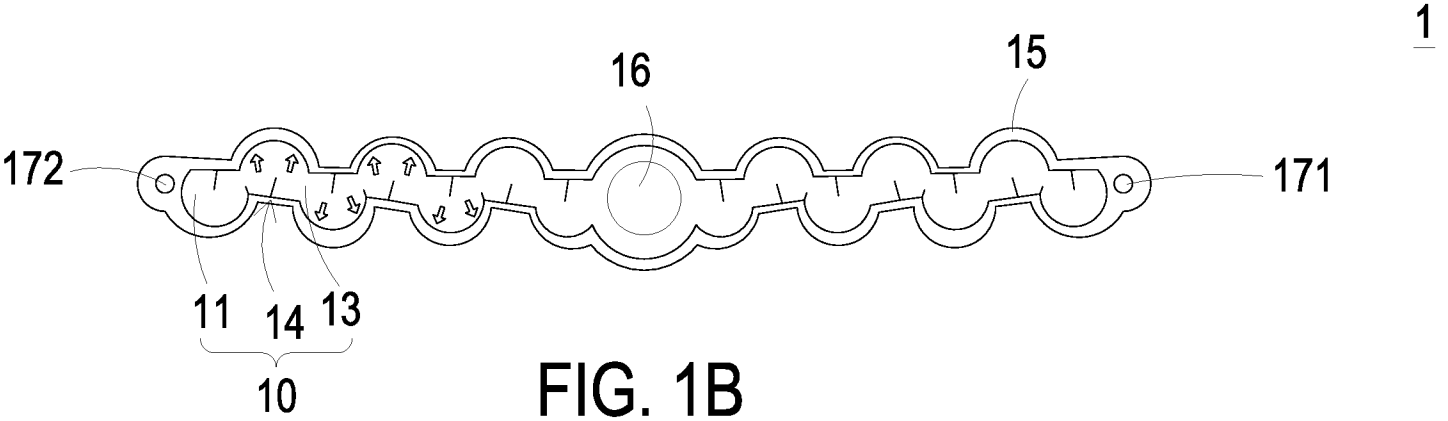
FIG. 1B schematically illustrates the inflation and expansion of the pneumatic elastic band of FIG. 1A.

Please refer to FIGS. 1A and 1B. FIG. 1A is a schematic perspective view illustrating a pneumatic elastic band according to an embodiment of the present disclosure. FIG. 1B schematically illustrates the inflation and expansion of the pneumatic elastic band of FIG. 1A. The pneumatic elastic band of the present disclosure is an elastic band that is inflated or vented to achieve loosening or tightening effect. The pneumatic elastic band can be used in various types of items such as shoelaces of sport shoes, elastic bands of pants, belts, buckle straps of helmets, straps of backpacks, straps of watches, . . . etc., but not limited herein. In this embodiment of the present disclosure, it is mainly described with shoelaces of the sport shoes. However, the present disclosure is not limited to be applied to the shoelaces of the sport shoes and can be applied to various products according to practical demands. As shown in FIG. 1A, the pneumatic elastic band 1 of the present embodiment mainly comprises an inflatable portion 10, an outer portion 15 and a nozzle 16. The inflatable portion 10 is disposed within the outer portion 15. The inflatable portion 10 includes a plurality of expansion portions 11 and a plurality of communication portions 13. Each of the communication portions 13 is connected between two of the expansion portions 11 which are adjacent to each other. As so, a plurality of gaps 14 are defined between each of the two adjacent expansion portions 11. The outer portion 15 of has a strip-shaped structure with elasticity. The outer portion 15 includes two fixing devices 171, 172 respectively disposed on two ends of the outer portion 15. The two fixing device 171, 172 may be buckled fixing devices. The nozzle 16 of the present embodiment is disposed on a surface of the outer portion 15, being in communication with the inflatable portion 10.

Please keep referring to FIG. 1A and FIG. 1B, in this embodiment, when a gas is guided into the inflatable portion 10 from an exterior of the pneumatic elastic band 1 through the nozzle 16, the expansion portions 11 of the inflatable portion 10 are inflated to become expanded. The expanded expansion portions 11 fill the gaps 14 and make the inflatable portion 10 contract inwardly, so that the outer portion 15 correspondingly contracts inwardly and deforms, as shown in FIG. 1B. On the contrary, when the gas is guided out of the inflatable portion 10 to the exterior of the pneumatic elastic band 1 through the nozzle 16, the inflatable portion 10 is deflated and loosened to return to an uninflated state, as shown in FIG. 1A.

Figure 2A:
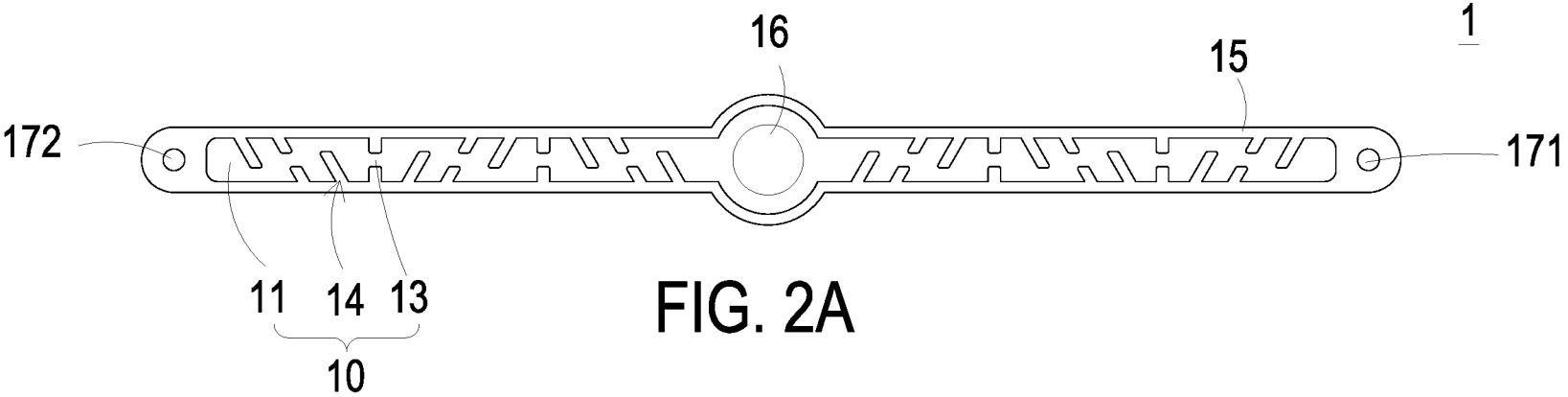
FIG. 2A is a schematic perspective view illustrating a pneumatic elastic band according to another embodiment of the present disclosure.
Figure 2B:
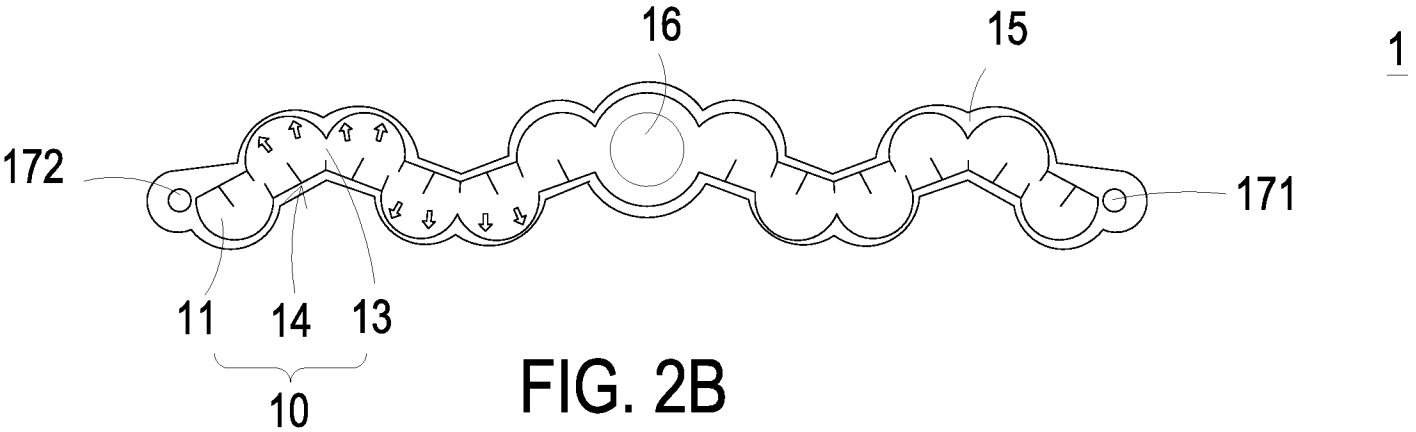
FIG. 2B schematically illustrates the inflation and expansion of the pneumatic elastic band of FIG. 2A.

Please simultaneously refer to FIG. 2A and FIG. 2B. FIG. 2A is a schematic perspective view illustrating a pneumatic elastic band according to another embodiment of the present disclosure. FIG. 2B schematically illustrates the inflation and expansion of the pneumatic elastic band of FIG. 2A. As shown in FIG. 2A, in another embodiment of the present disclosure, the pneumatic elastic band 1 also comprises the inflatable portion 10, the outer portion 15 and the nozzle 16. The inflatable portion 10 is disposed within the outer portion 15, and the inflatable portion 10 also comprises a plurality of expansion portions 11, a plurality of communication portions 13 and a plurality of gaps 14. The only difference distinct from the above-mentioned embodiment is that the tilt angle of disposing the plurality of expansion portions 11 is unequal. The rest structures and their interconnection are similar to the above-mentioned embodiment, so are not redundantly described herein. Similarly, when a gas is guided into the inflatable portion 10 from an exterior of the pneumatic elastic band 1 through the nozzle 16, the expansion portions 11 of the inflatable portion 10 are inflated to become expanded. The expanded expansion portions 11 fill the gaps 14 and make the inflatable portion 10 contract inwardly, so that the outer portion 15 correspondingly contracts inwardly and deforms, as shown in FIG. 1B. On the contrary, when the gas is guided out of the inflatable portion 10 to the exterior of the pneumatic elastic band 1 through the nozzle 16, the inflatable portion 10 is deflated and loosened to return to an uninflated state, as shown in FIG. 1A.

Figure 3:
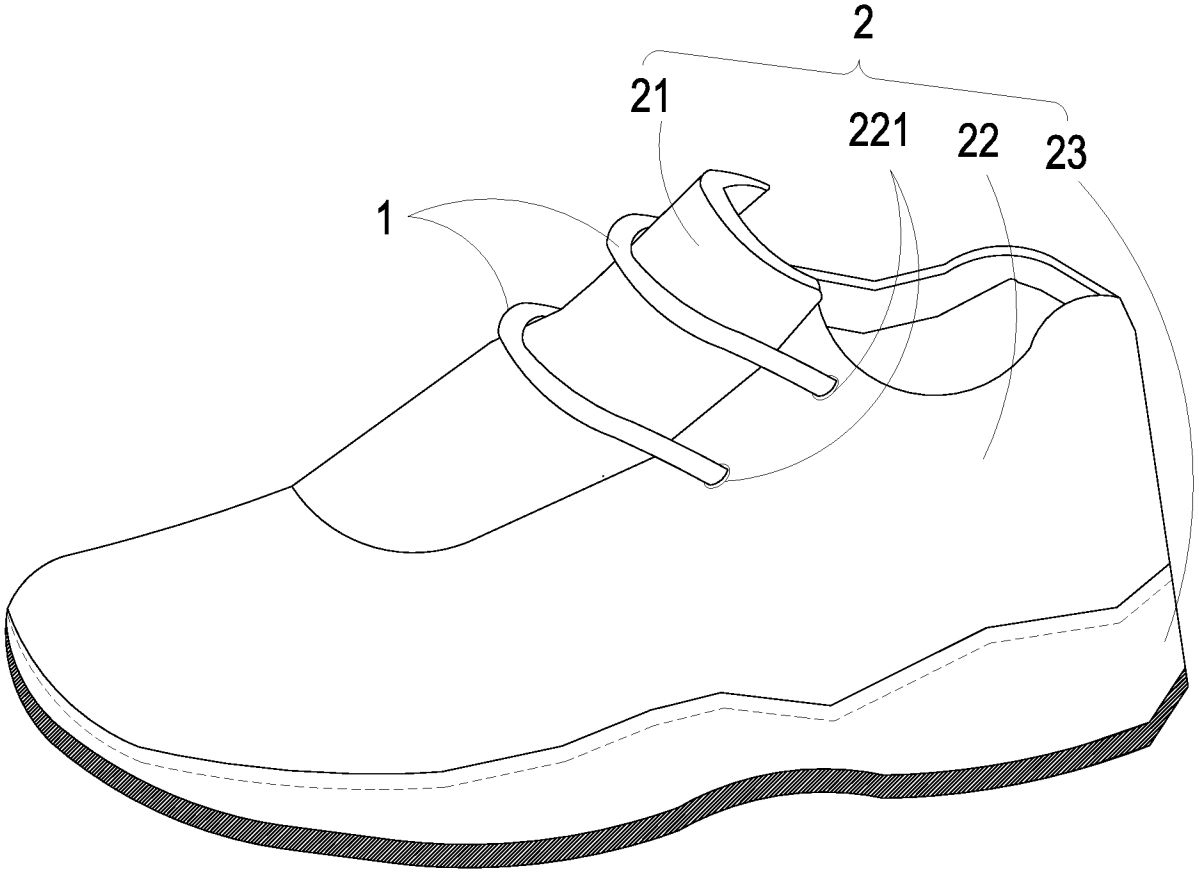
FIG. 3 schematically illustrates the pneumatic elastic band applied to a sport shoe according to an embodiment of the present disclosure.

The operation of the pneumatic elastic band of the present disclosure applied to a sport shoe is described below. Please refer to FIG. 3. FIG. 3 schematically illustrates the pneumatic elastic band applied to a sport shoe according to an embodiment of the present disclosure. The pneumatic elastic band 1 of the present embodiment can be applied to each type of shoes (e.g. sport shoes, sandals, high heels, etc.), but not limited herein. As shown in FIG. 3, the shoe to which the pneumatic elastic band 1 of the present embodiment is applied is exemplified by a sport shoe 2. The sport shoe 2 includes a shoe tongue 21, a shoe body 22 and a bottom part 23. The shoe body 22 and the bottom part 23 are connected with each other and commonly define an opening 24 and a wearing space (not shown), wherein the user wears the sport shoe 2 by putting the foot into the opening 24 and the foot is received by the wearing space. The shoe tongue 21 is connected to the shoe body 22 for adjusting the size of the opening. Furthermore, there are a plurality of eyelets 221 symmetrically disposed on two sides of the shoe body 22, so that the two fixing devices 171, 172 of the pneumatic elastic band 1 can be connected to the eyelets 221 to be disposed.

Figure 4A:
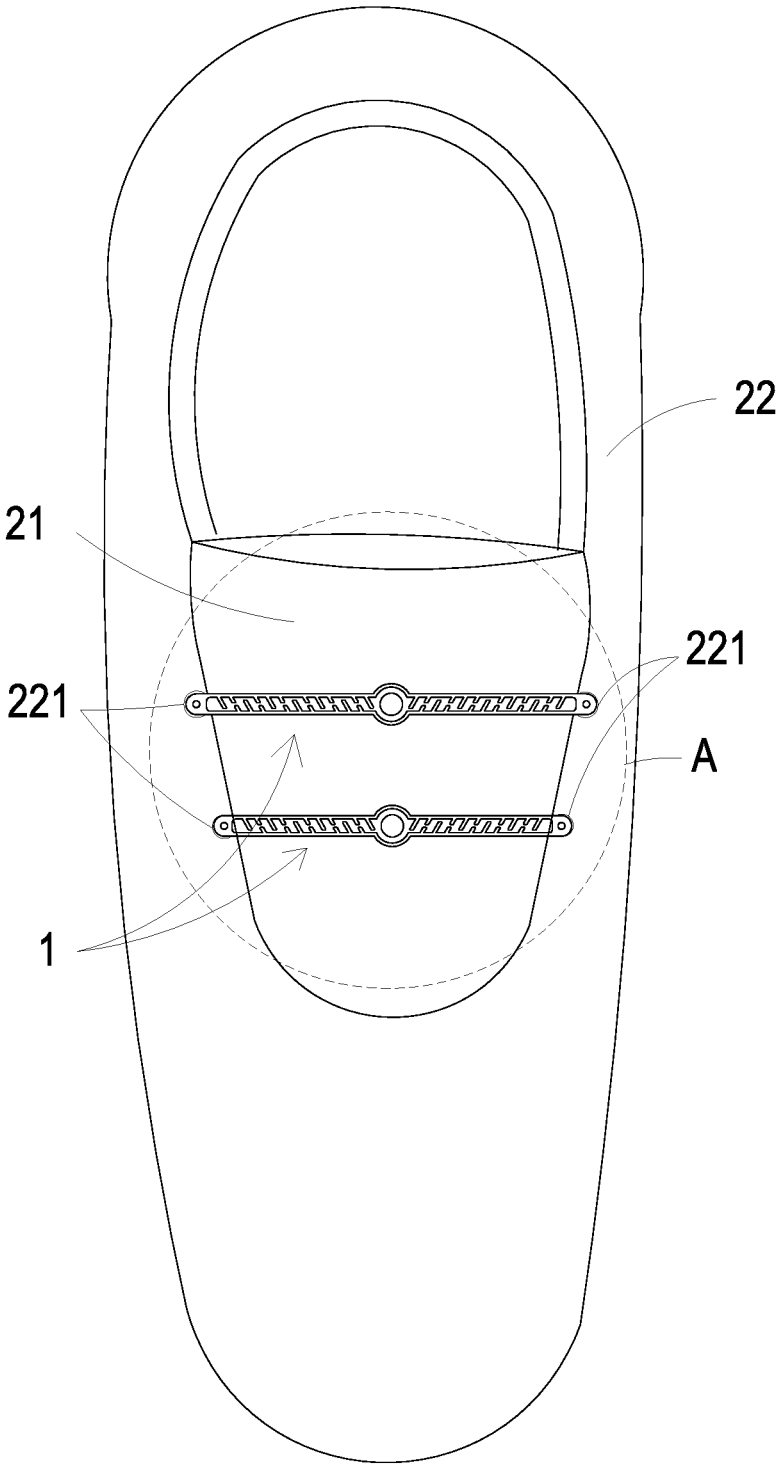
FIG. 4A schematically illustrates the top view of the pneumatic elastic band disposed on the sport shoe according to an embodiment of the present disclosure.
Figure 4B:
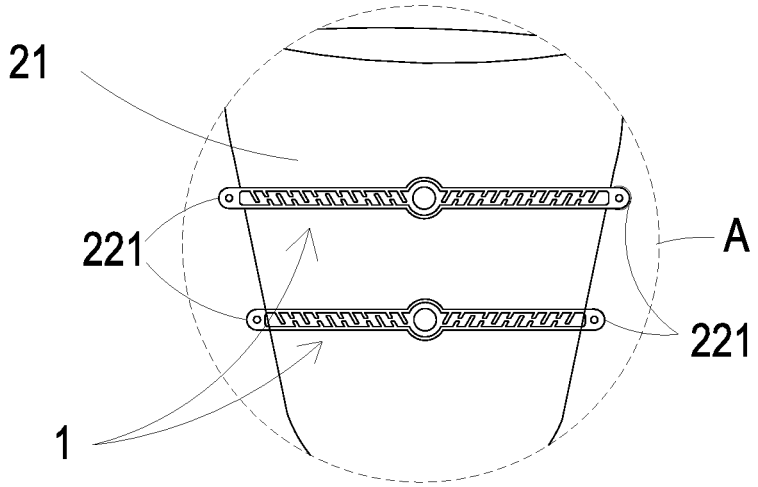
FIG. 4B is the partially enlarged view of the broken line portion A of FIG. 4A.
Figure 4C:
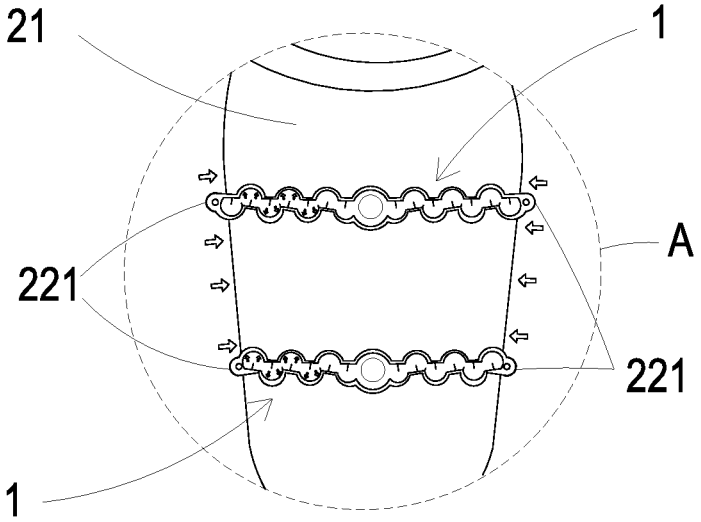
FIG. 4C is the schematic perspective view of the inflated and expanded state of the pneumatic elastic band of FIG. 4B.

Please refer to FIGS. 4A to 4C. FIG. 4A schematically illustrates the top view of the pneumatic elastic band disposed on the sport shoe according to an embodiment of the present disclosure. FIG. 4B is the partially enlarged view of the broken line portion A of FIG. 4A. FIG. 4C is the schematic perspective view of the inflated and expanded state of the pneumatic elastic band of FIG. 4B. The sport shoe 2 of the present embodiment can be disposed with one or more pneumatic elastic bands 1, wherein the amount and disposing method can all be varied according to the practical situation. The present embodiment is exemplified by using two pneumatic elastic bands 1 in the sport shoe 2. As shown in FIG. 4A, the two pneumatic elastic bands 1 of the present embodiment are disposed on the shoe tongue 21, each of which has its fixing devices 171, 172 on two ends thereof respectively connected to two eyelets 221 symmetrically disposed on the shoe body 22, but not limited herein. Please refer to FIG. 4B and FIG. 4C, when a gas is guided into the pneumatic elastic bands 1, the pneumatic elastic bands 1 is inflated and contracts inwardly as shown in FIG. 4C, thereby achieving the same effect as tightening normal shoelaces. On the contrary, when the gas is guided out of the pneumatic elastic bands 1, the pneumatic elastic bands 1 is deflated and loosened to return to an uninflated state as shown in FIG. 4B, thereby achieving the same effect as loosening normal shoelaces. Through inflating the pneumatic elastic band 1, a rapid tightening effect can be achieved, and additionally avoiding unwanted loosening situations often brought about by normal shoelaces, thereby enhancing the safety and convenience when wearing the shoe. Meanwhile, as utilizing the gas as a filler, the pneumatic elastic band 1 has elasticity like a balloon, thus avoiding the uncomfortable feelings caused by tightening the conventional shoelaces. Hence, the comfort of wearing the shoe is enhanced.

In some embodiments, the pneumatic elastic band 1 further includes an airflow valve (not shown). The airflow valve is disposed on the nozzle 16 of the pneumatic elastic band 1 for controlling a flow of the gas in and out of the inflatable portion 10. When the airflow valve is closed, the airflow valve seals the nozzle 16 to hold the gas inside the inflatable portion 10, thus preventing backflow of the gas. When the airflow valve is opened, the airflow valve stops sealing the nozzle 16, so that the inflation portion 10 is in communication with the exterior of the pneumatic elastic band 1 through the nozzle 16 and is able to be inflated or deflated by the nozzle 16. The disposing method of the airflow valve can be varied according to the practical situations and not limited herein.

Figure 5A:
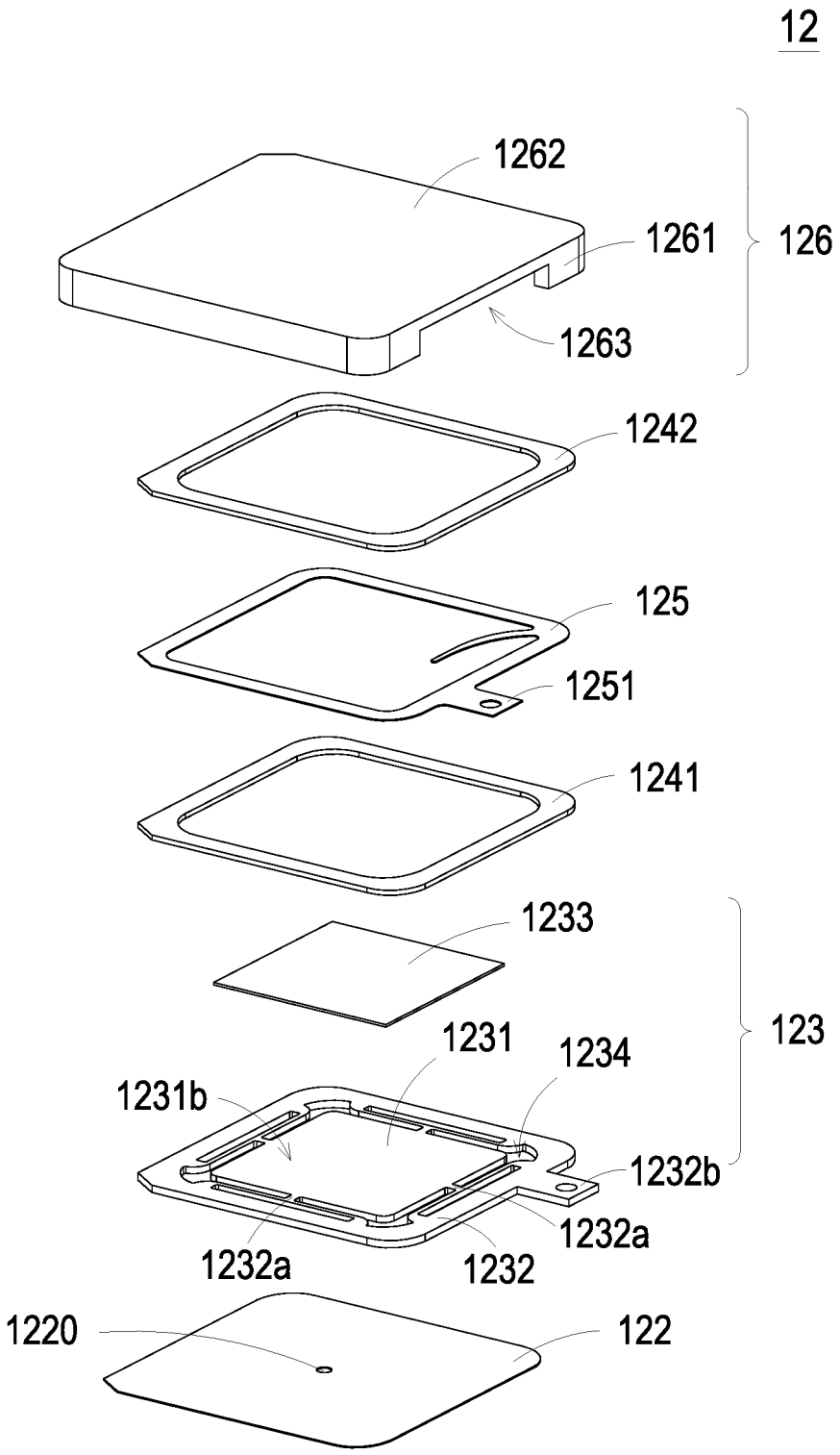
FIG. 5A is a front exploded view illustrating the gas pump according to an embodiment of the present disclosure.
Figure 5B:
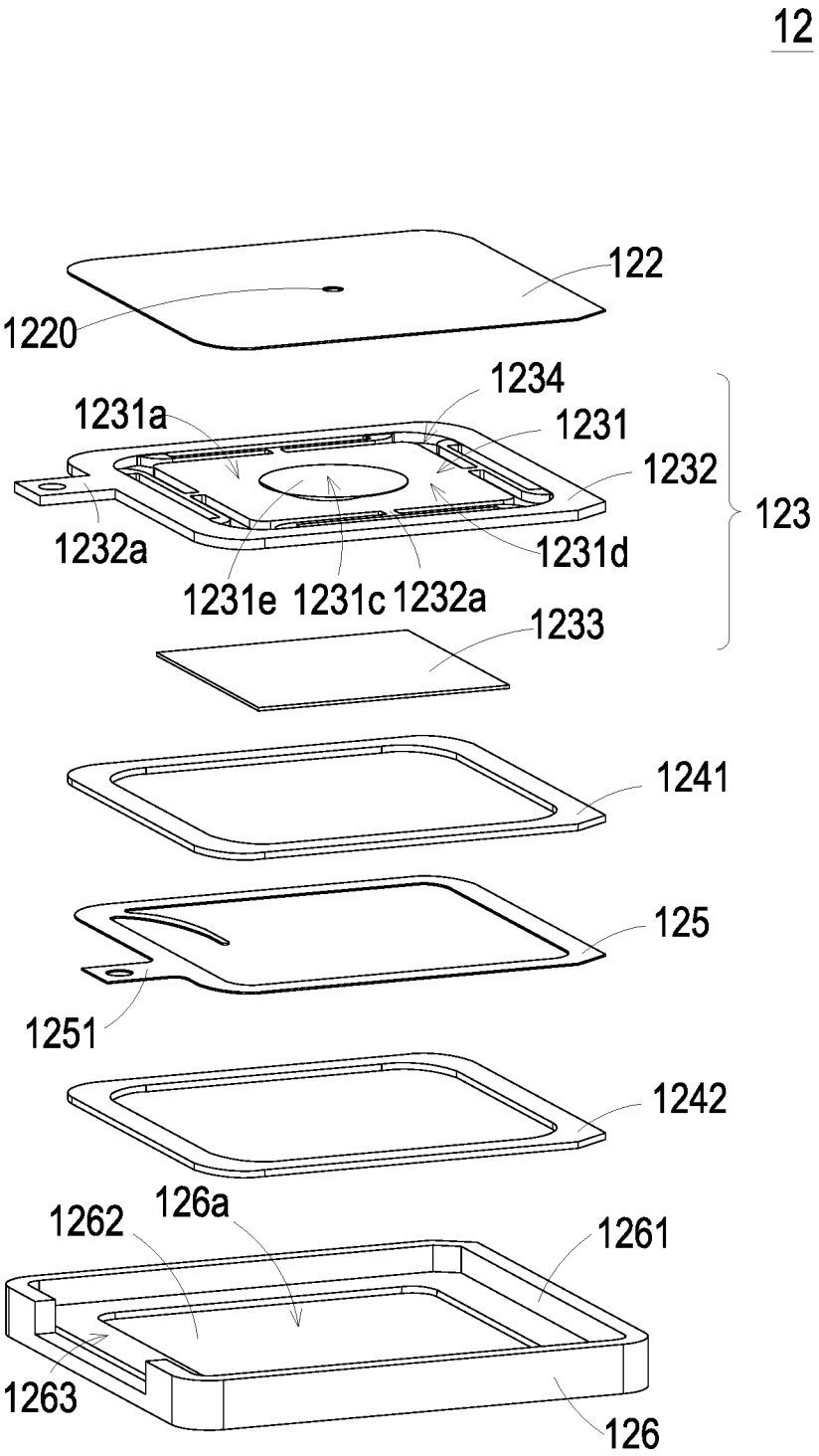
FIG. 5B is a rear exploded view illustrating the gas pump according to the embodiment of the present disclosure.

Please refer to FIGS. 5A and 5B. FIG. 5A is a front exploded view illustrating the gas pump according to an embodiment of the present disclosure. FIG. 5B is a rear exploded view illustrating the gas pump according to the embodiment of the present disclosure. The pneumatic elastic band 1 (as shown in FIGS. 2A to 3B) of the present embodiment is inflated by a gas pump 12, but not limited herein. The gas pump 12 is a piezoelectric actuated gas pump, which can be a detachable gas pump, communicating with the nozzle 16 (as shown in FIGS. 2A to 3B) for guiding the gas into the inflatable portion 10 (as shown in FIGS. 2A to 3B) through the nozzle 16, but not limited herein. In some other embodiments, the gas pump 12 is an embedded-in gas pump. In some other embodiments, the pneumatic elastic band 1 (as shown in FIGS. 2A to 3B) is inflated by an inflating device (e.g. an inflator) connected with the nozzle 16. In the present embodiment, the gas pump 12 is a piezoelectric actuated gas pump for driving the gas to flow. As shown in FIG. 5A and FIG. 5B, the gas pump 12 of the present disclosure includes a resonance plate 122, a piezoelectric actuator 123 and the cover plate 126. The resonance plate 122 is spatially corresponding to the piezoelectric actuator 123. The resonance plate 122 includes a central aperture 1220 and a movable portion (not shown). The central aperture 1220 is disposed on the central area of the resonance plate 122, but not limited thereto. The movable portion is disposed around the central aperture 1220. The piezoelectric actuator 123 includes a suspension plate 1231, an outer frame 1232 and a piezoelectric element 1233. The suspension plate 1231 can be but not limited to a square-shaped suspension plate and may have a bulge 1231*e*. The suspension plate 1231 includes a central portion 1231*c* and a peripheral portion 1231*d*. When a voltage is applied to the piezoelectric element 1233, the suspension plate 1231 is subjected to a bending vibration from the central portion 1231*c* to the peripheral portion 1231*d*. The outer frame 1232 is arranged around the suspension plate 1231 and includes at least one bracket 1232*a* and a conducting pin 1232*b*, but not limited thereto. Each bracket 1232*a* has its two ends respectively connected to the suspension plate 1231 and the outer frame 1232 to be connected therebetween, thus providing an elastically support to the suspension plate 1231. The conducting pin 1232*b* protrudes outwardly from the outer frame 1232 for an electrically external connection. The piezoelectric element 1233 is attached to a second surface 1231*b* of the suspension plate 1231. A side length of the piezoelectric element 1233 is equal to or less than a side length of the suspension plate 1231. When a voltage is applied to the piezoelectric element 1233, the piezoelectric element 1233 drives the suspension plate 1231 to undergo the bending vibration. The cover plate 126 includes at least one sidewall 1261, a bottom plate 1262 and an opening portion 1263. The sidewalls 1261 is protruding from the periphery of the bottom plate 1262, so that the sidewalls 1261 and the bottom plate 1262 commonly define an accommodation space 126*a*. The resonance plate 122 and the piezoelectric actuator 123 are accommodated within the accommodation space 126*a*. The opening portion 1263 is disposed on the sidewall 1261, so that the conducting pin 1232*b* of the outer frame 1232 passes through the opening portion 1263 and protrudes out of the cover plate 126 for being electrically connected with an external power, but not limited thereto.

In the embodiment, the gas pump 12 of the present disclosure further includes a first insulation plate 1241, a second insulation plate 1242 and a conducting plate 125, but not limited thereto. The first insulation plate 1241 and the second insulation plate 1242 are disposed on the top and the bottom of the conducting plate 125, respectively, and have the profiles substantially matching the profile of the piezoelectric actuator 123. The first insulation plate 1241 and the second insulation plate 1242 can be made of an insulating material, for example but not limited to a plastic material, for providing insulating efficacy. The conducting plate 125 is made of an electrically conductive material, for example but not limited to a metallic material, for providing electrically conducting efficacy. The conducting plate 125 has its profile substantially matching the profile of the outer frame 1232 of the piezoelectric actuator 123, but the present disclosure is not limited thereto. Moreover, the conducting plate 125 may have a conducting pin 1251 for an electrically external conduction. Being similar to the conducting pin 1232*b* of the outer frame 1232, the conducting pin 1251 passes through the opening portion 1263 and protrudes out of the cover plate 126 for being electrically connected with the control module 15.

Figure 6A:
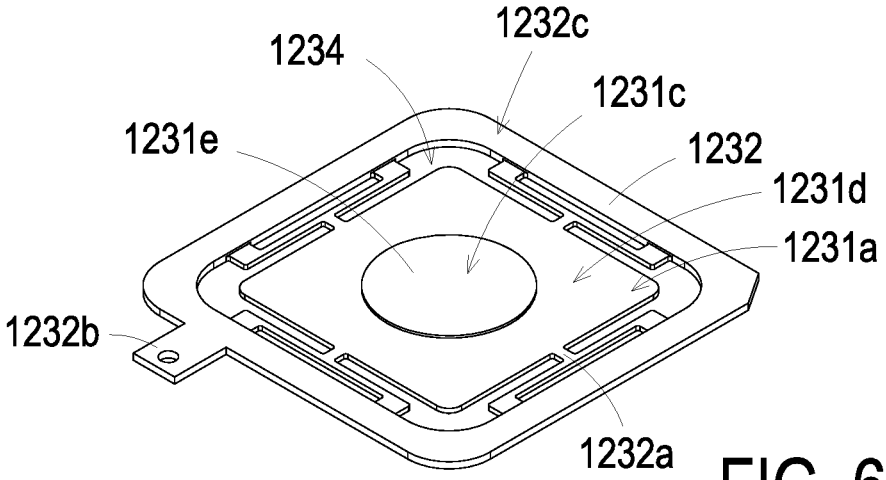
FIG. 6A is a front view illustrating the piezoelectric actuator of FIGS. 5A and 5B.
Figure 6B:
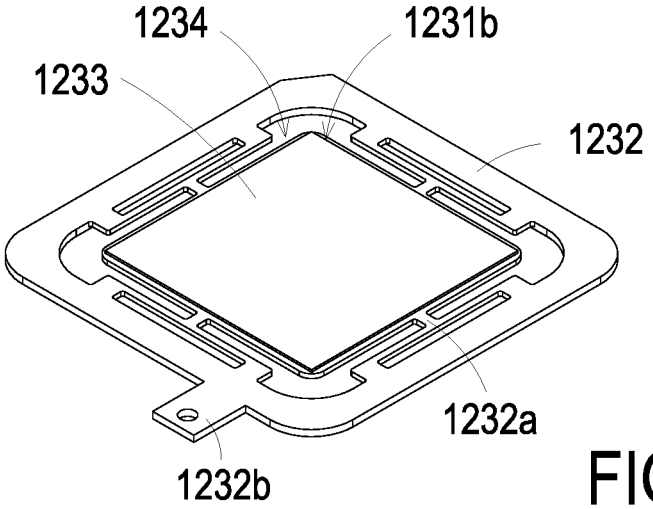
FIG. 6B is a rear view illustrating the piezoelectric actuator of FIGS. 5A and 5B.
Figure 6C:
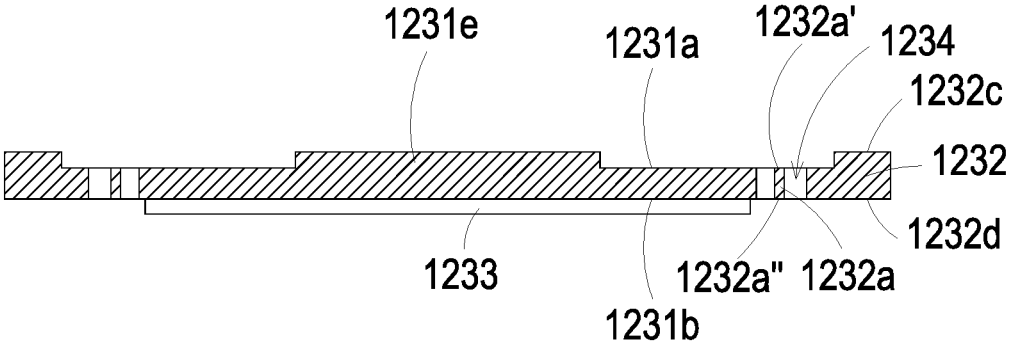
FIG. 6C is a cross-sectional view illustrating the piezoelectric actuator of FIGS. 5A and 5B.

Please refer to FIGS. 6A to 6C. FIG. 6A is a front view illustrating the piezoelectric actuator of FIGS. 5A and 5B. FIG. 6B is a rear view illustrating the piezoelectric actuator of FIGS. 5A and 5B. FIG. 6C is a cross-sectional view illustrating the piezoelectric actuator of FIGS. 5A and 5B. As shown in FIGS. 6A to 6C, in the embodiments, the suspension plate 1231 has a stepped structure. The suspension plate 1231 further includes a bulge 1231*e* disposed on the central portion 1231*c* of the first surface 1231*a*. The bulge 1231*e* can be a circular protrusion structure, but not limited thereto. In some embodiments, the suspension plate 1231 can be a double-sided planar square plate. Furthermore, as shown in FIG. 6C, the bulge 1231*e* of the suspension plate 1231 and the first surface 1232*c* of the outer frame 1232 are coplanar, and the first surface 1231*a* of the suspension plate 1231 and the first surface 1232*a*' of the bracket 1232*a* are coplanar. In addition, the bulge 1231*e* of the suspension plate 1231 and the first surface 1232*c* of the outer frame 1232 have a specific depth relative to the first surface 1231*a* of the suspension plate 1231 and the first surface 1232*a*' of the bracket 1232*a*. As shown in FIGS. 6B and 6C, the second surface 1231*b* of the suspension plate 1231, the second surface 1232*d* of the outer frame 1232 and the second surface 1232*a*" of the bracket 1232*a* are formed as a flat coplanar structure. The piezoelectric element 1233 is attached to the flat second surface 1231*b* of the suspension plate 1231. In some embodiments, the suspension plate 1231 can be a double-sided planar square plate, but not limited thereto. The type of the suspension plate 1231 is adjustable according to the practical requirements. In some embodiments, the suspension plate 1231, the outer frame 1232 and the bracket 1232*a* can be formed as an integrated one-piece structure, and made of a metal plate, for example but not limited to a stainless steel plate. Moreover, in the embodiment, the gas pump 12 further includes at least one interspace 1234 disposed among the suspension plate 1231, the outer frame 1232 and the bracket 1232*a* for allowing the gas to pass therethrough.

Figure 7:
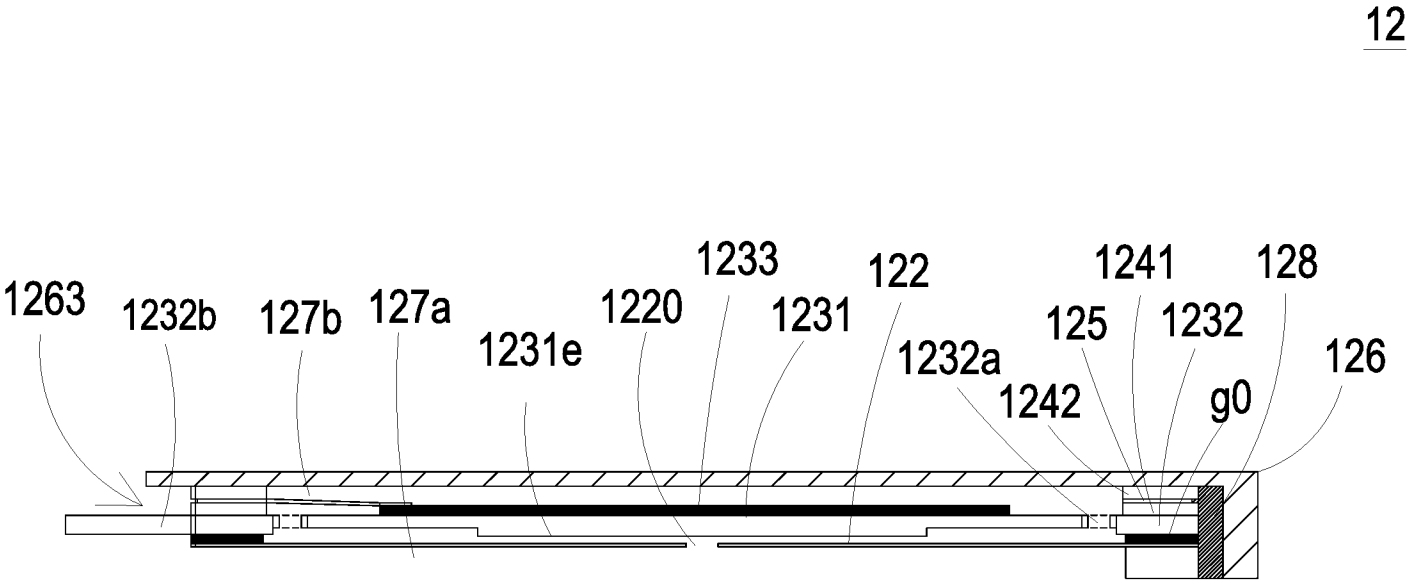
FIG. 7 is a cross-sectional view illustrating the gas pump of FIGS. 5A and 5B.

Please refer to FIG. 7. FIG. 7 is a cross-sectional view illustrating the gas pump of FIGS. 5A and 5B. As shown in FIG. 7, the gas pump 12 includes the cover plate 126, the second insulation plate 1242, the conducting plate 125, the first insulation plate 1241, the piezoelectric actuator 123 and the resonance plate 122 stacked on each other from top to bottom sequentially. While the piezoelectric actuator 123, the first insulation plate 1241, the conducting plate 125 and the second insulation plate 1241 have been assembled and stacked, an adhesive 128 is coated around the periphery of the assembled structure to accomplish sealing. The assembled gas pump 12 is a quadrilateral structure, but not limited thereto. The shape can be adjustable according to the practical requirements. In addition, in the embodiment, only the conducting pin 1251 of the conducting plate 125 and the conducting pin 1232*b* (shown in FIG. 5A) of the piezoelectric actuator 123 are protruding out of the cover plate 126 for being electrically connected with an external power, but not limited thereto. After gas pump 12 has been assembled, the first chamber 127*b* is formed between the cover plate 126 and the resonance plate 122.

In the embodiment, the gas pump 12 of the present disclosure has a gap g0 between the resonance plate 122 and the piezoelectric actuator 123, and a conductive material, for example but not limited to a conductive adhesive, is filled into the gap g0. Consequently, the depth of the gap g0 between the resonance plate 122 and the bulge 1231*e* of the suspension plate 1231 of the piezoelectric actuator 123 is maintained, which is capable of guiding the gas to flow more quickly. Moreover, due to the proper distance between the bulge 1231*e* of the suspension plate 1231 and the resonance plate 122, the contact interference is reduced and the generated noise is largely reduced. In other embodiments, by adding the height of the outer frame 1232 of the piezoelectric actuator 123, the gap g0 is produced when the outer frame 1232 is assembled with the resonance plate 122. When the piezoelectric actuator 123 is driven to perform a gas collection operation, the gas is guided into the opening portion 1263 of the cover plate 126 and converged to the convergence chamber 127*a*. Then the gas flows through the central aperture 1220 of the resonance plate 122 to be temporarily stored in the first chamber 127*b*. When the piezoelectric actuator 123 is driven to perform a gas discharge operation, the gas is transported from the first chamber 127*b* to the convergence chamber 127*a* through the central aperture 1220 of the resonance plate 122, and introduced into the inflatable portion 10 through the nozzle 16.

Figure 8A:
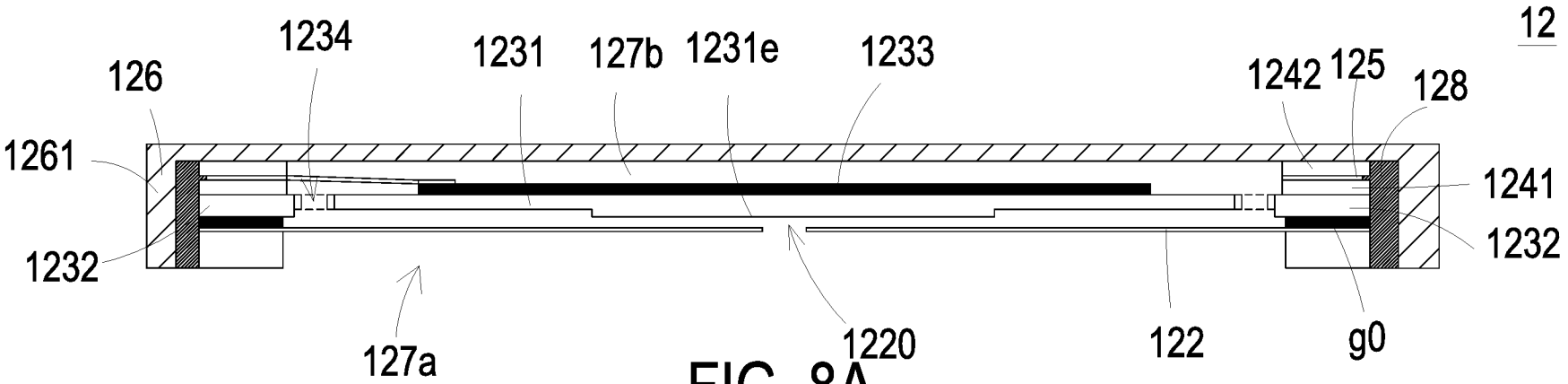
FIGS. 8A to 8D illustrate an operating process of the gas pump according to an embodiment of the present disclosure.

The operating process of the gas pump 12 is further described as below. Please refer to FIGS. 8A to 8D. FIGS. 8A to 8D illustrate an operating process of the gas pump according to an embodiment of the present disclosure. Firstly, as shown in FIG. 8A, the structure of the gas pump 12 is similar to that in the foregoing descriptions, being assembled by sequentially stacking and positioning the cover plate 126, the second insulation plate 1242, the conducting plate 125, the first insulation plate 1241, the piezoelectric actuator 123 and the resonance plate 122. There is a gap g0 provided between the resonance plate 122 and the piezoelectric actuator 123 so that the first chamber 127*b* is formed between the resonance plate 122 and the piezoelectric actuator 123. Moreover, the resonance plate 122 and the sidewalls 1261 of the cover plate 126 collaboratively define the convergence chamber 127*a*. When the gas pump 12 has not been driven by a voltage, the positions of the components are illustrated in FIG. 8A.

Figure 8B:
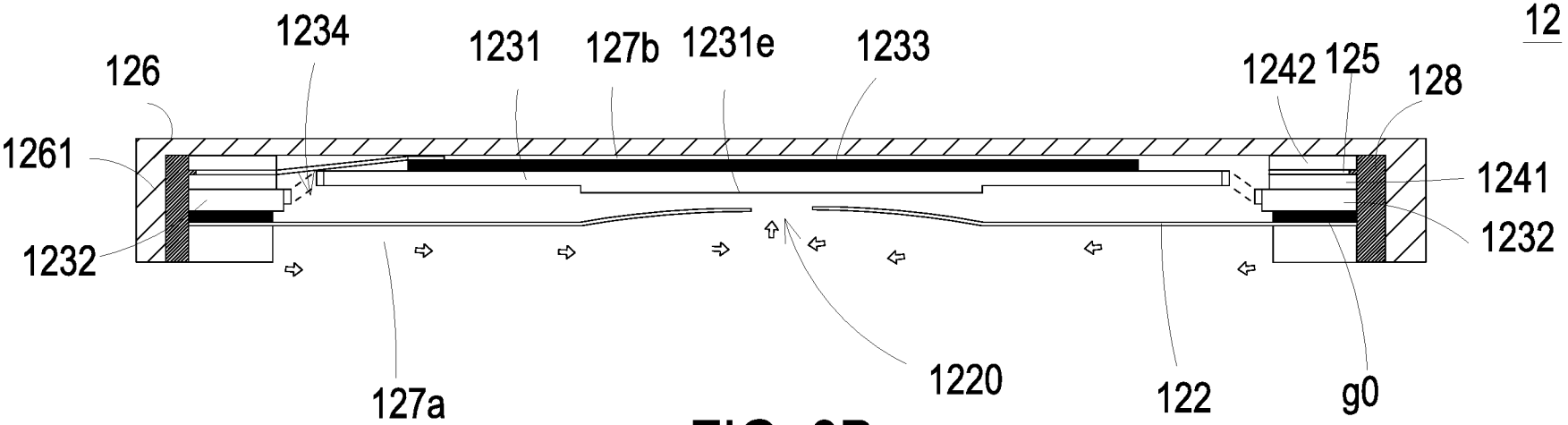

Further as shown in FIG. 8B, when the piezoelectric actuator 123 of the first pump 12 is driven by a voltage and vibrates upwardly, the gas is introduced from the opening portion 1263 of the cover plate 126 into the gas pump 12 and converges to the convergence chamber 127*a*. Simultaneously, resonance occurs between the suspension plate 1231 of the piezoelectric actuator 123 and the resonance plate 122, so that the resonance plate 122 undergoes a reciprocating vibration. Namely, the part of the resonance plate 122 around the central aperture 1220 slightly deforms upwardly.

Figure 8C:
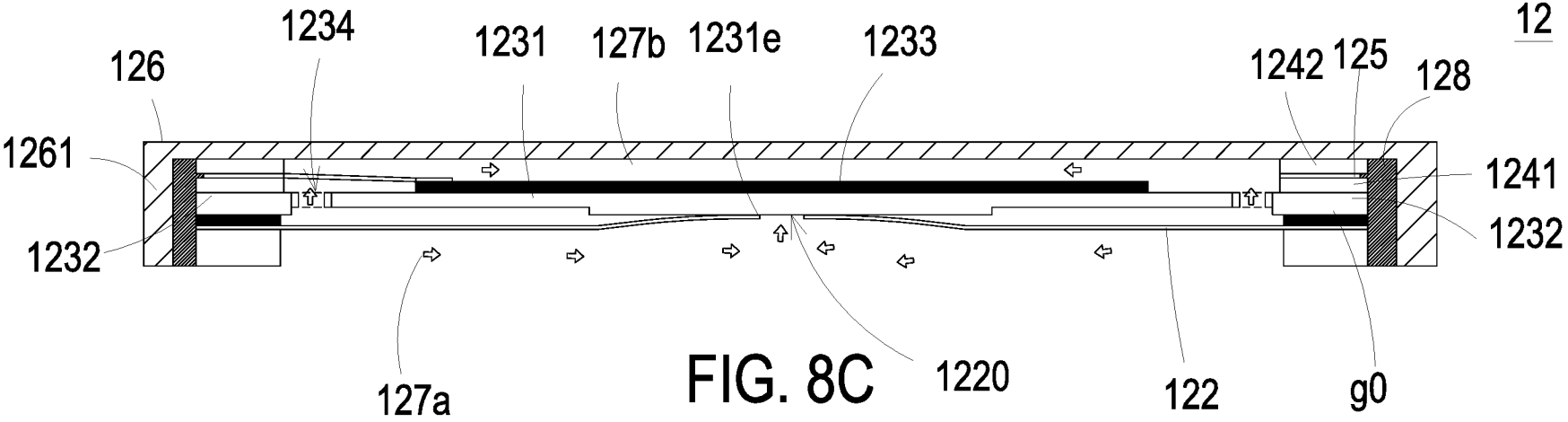

Afterward, as shown in FIG. 8C, the piezoelectric actuator 123 vibrates downwardly to the original position. Meanwhile, the bulge 1231*e* of the suspension plate 1231 of the piezoelectric actuator 123 is close to the upward protruded portion of the resonance plate 122 at the central aperture 1220. It makes the gas in the gas pump 12 temporarily stored in the upper half layer of the first chamber 127*b*.

Figure 8D:
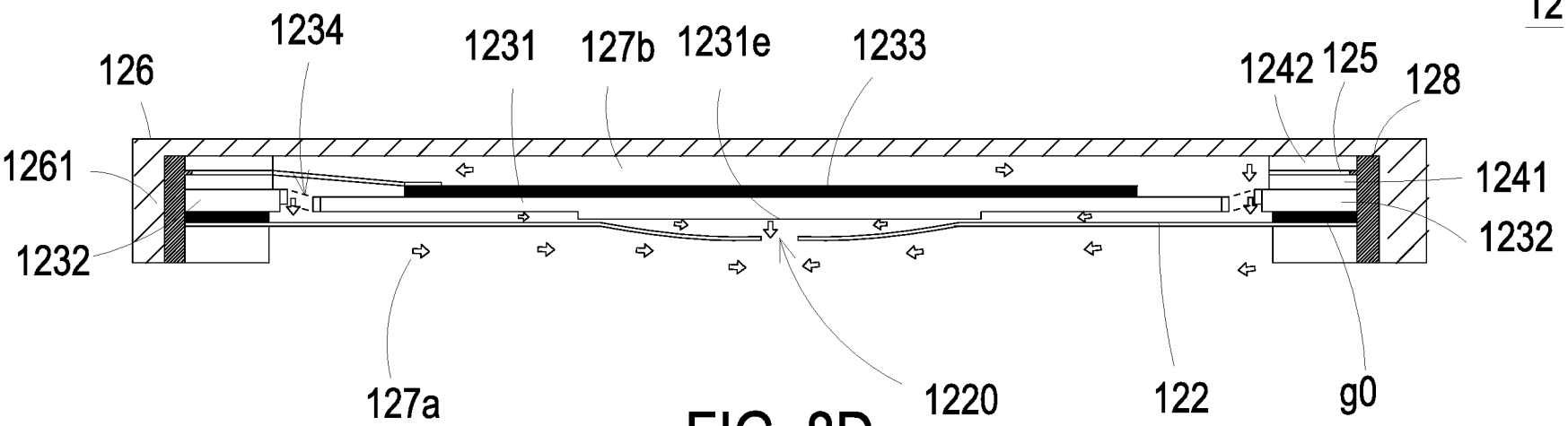

As shown in FIG. 8D, the piezoelectric actuator 123 further vibrates downwardly and the resonance plate 122 also vibrates downwardly due to the resonance of the piezoelectric actuator 123. With the downward deformation of the resonance plate 122 which shrinks the volume of the first chamber 127*b*, the gas in the upper half layer of the first chamber 127*b* is pushed to flow toward the both sides and downwardly pass through the interspace 1234 of the piezoelectric actuator 123, so as to be transferred to the central aperture 1220 of the resonance plate 122 and compressed to be discharged. In this aspect of this embodiment, when the resonance plate 122 performs the vertical reciprocating vibration, the gap g0 between the resonance plate 122 and the piezoelectric actuator 123 increases a maximum vertical displacement of the resonance plate 122 during its vibration. In other words, the gap g0 provided between the resonance plate 122 and the piezoelectric actuator 123 allows the resonance plate 122 to vibrate at a greater amplitude when it is in resonant motion.

Finally, the resonance plate 122 returns to the original position as shown in FIG. 8A, and the gas pump 12 keeps repeating the above-mentioned operating process depicted in FIGS. 8A to 8D, so that the gas is continuously fed from the opening portion 1263 of the cover plate 126 into the convergence chamber 127*a* and flows to the first chamber 127*b*. Afterward, the gas is further transferred from the first chamber 127*b* to the convergence chamber 127*a*, and flows in the inflatable portion 10 through the nozzle 16 stably. In other words, when the gas pump 12 of the present disclosure is in operation, the gas flows through the opening portion 1263 of the cover plate 126, the convergence chamber 127*a*, the first chamber 127*b*, the convergence chamber 127*a* and the nozzle 16, sequentially. Since the gas pump 12 of the present disclosure has the cover plate 126 with the opening portion 1263, the number of the components is reduced in comparison with the conventional gas pump and the manufacturing process is simplified.

Figure 9A:
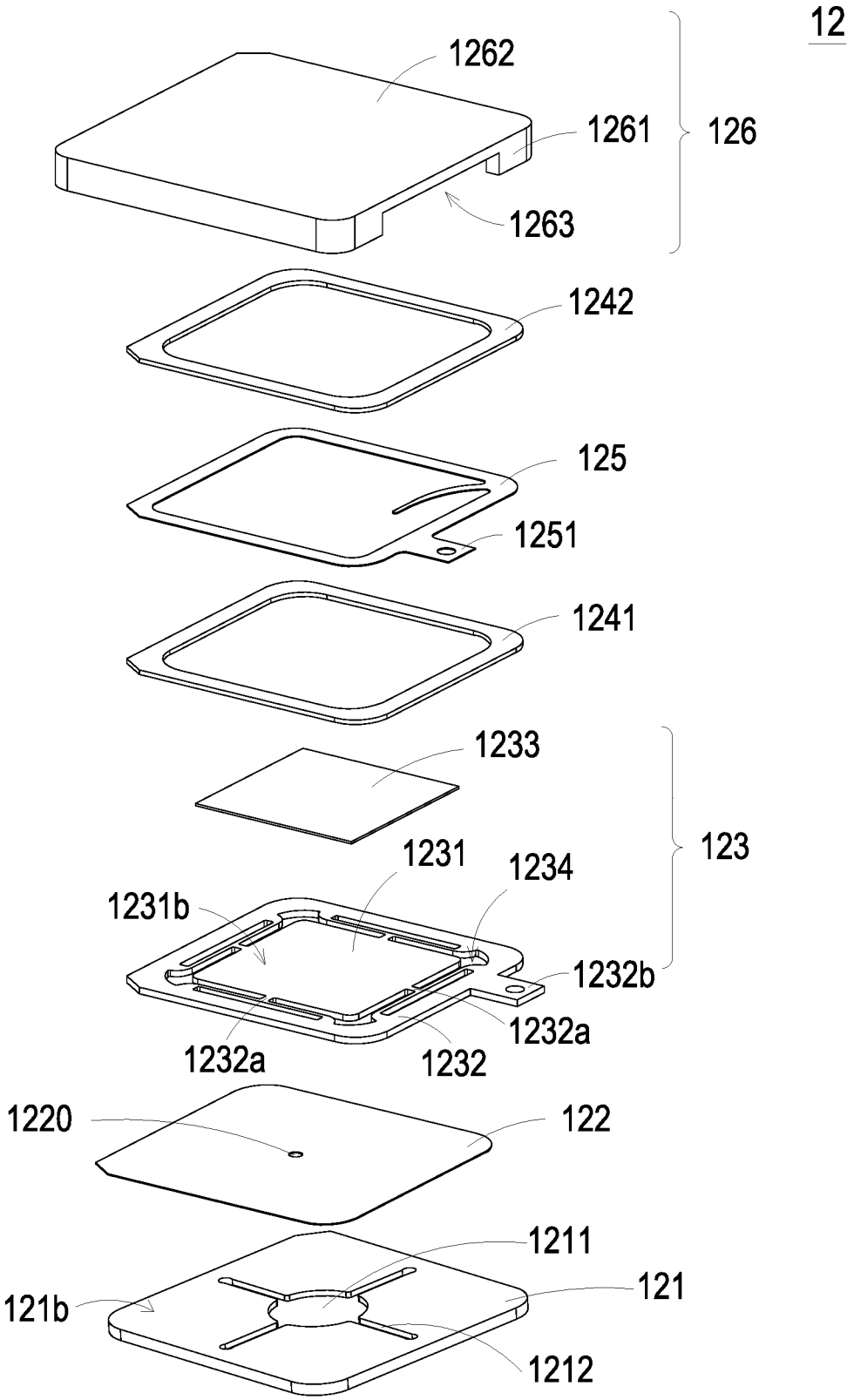
FIGS. 9A and 9B are respectively different exploded views illustrating the gas pump according to another embodiment of the present disclosure.
Figure 9B:
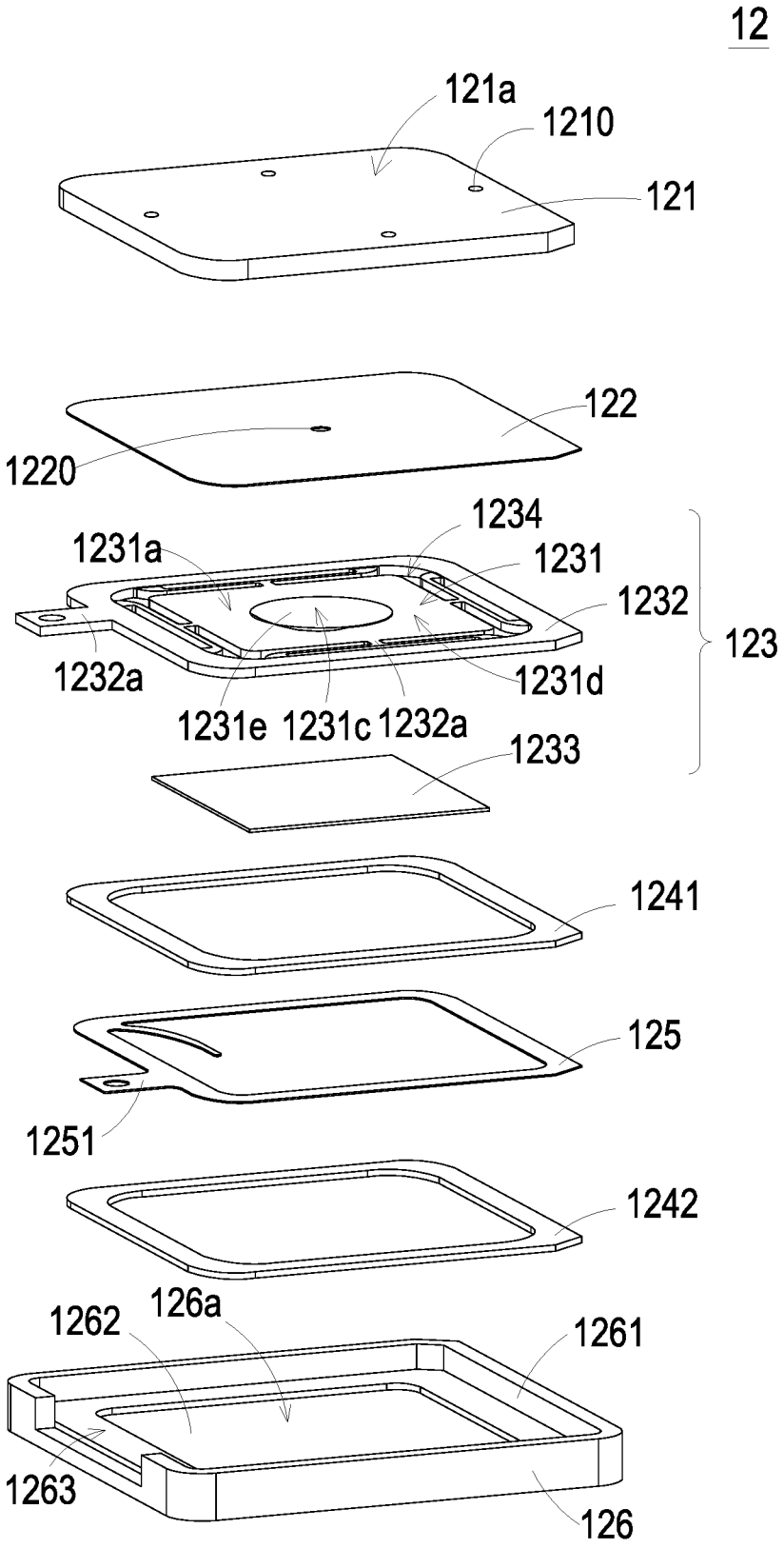

Please refer FIGS. 9A and 9B. FIG. 9A is a front exploded view illustrating the gas pump according to another embodiment of the present disclosure. FIG. 9B is a rear exploded view illustrating the gas pump according to another embodiment of the present disclosure. In this embodiment, the gas pump 12 is also composed of the cover plate 126, the second insulation plate 1242, the conducting plate 125, the first insulation plate 1241, the piezoelectric actuator 123 and the resonance plate 122 which are stacked on each other sequentially. Those elements and configurations are similar to those of the former embodiment so are not redundantly described herein. Being distinct from the former embodiment, the gas pump 12 in this embodiment further includes an inlet plate 121. The inlet plate 121 is aligned with the resonance plate 122 and stacked thereon. The inlet plate 121 includes a first surface 121*a*, a second surface 121*b* and at least one inlet 1210. In the embodiment, the inlet plate 121 has four inlets 1210, but not limited thereto. The inlets 1210 runs through the first surface 121*a* and the second surface 121*b*. The gas is fed into the gas pump 12 through the at least one inlet 1210 in response to the action of the atmospheric pressure. In addition, as shown in FIG. 9A, the inlet plate 121 includes at least one convergence channel 1212 disposed on the first surface 121*a* and spatially corresponding to the at least one inlet 1210 on the second surface 121*b* of the inlet plate 121. There is a central cavity 1211 formed at the intersection of those convergences channels 1212. The central cavity 1211 is in communication with the convergence channels 1212. Thus, the gas fed into the convergence channels 12 through the at least one inlet 1210 can be converged and transferred to the central cavity 1211. As a result, the gas is effectively converged to at the central aperture 1220 of the resonance plate 122 and transferred to the interior of the gas pump 12. The inlet plate 121 is an integrated one-piece structure formed with the inlets 1210, the convergence channels 1212 and the central cavity 1211. The convergence chamber is formed in the central cavity 1211 for temporarily storing the gas. In some embodiments, the material of the inlet plate 121 can be for example but not limited to the stainless steel. In other embodiments, the depth of the convergence chamber and the depth of those convergence channels 1212 are equal. The resonance plate 122 can be made of for example but not limited to a flexible material. Moreover, the resonance plate 122 has a central aperture 1220 corresponding to the central cavity 1211 on the second surface 121*b* of the inlet plate 121, so as to allow the gas to flow therethrough downwardly. In other embodiments, the resonance plate 122 can be made of copper.

According to the above description, through the operation of the gas pump 12, the gas is guided from the exterior of the pneumatic elastic band 1 into the inflatable portion 10 through the nozzle 16, and the inflatable portion 10 is inflated to expand and thus contracts inwardly, thereby tightening the sport shoe 2 to make the foot of the user stably fixed in the sport shoe 2.

Figure 10:
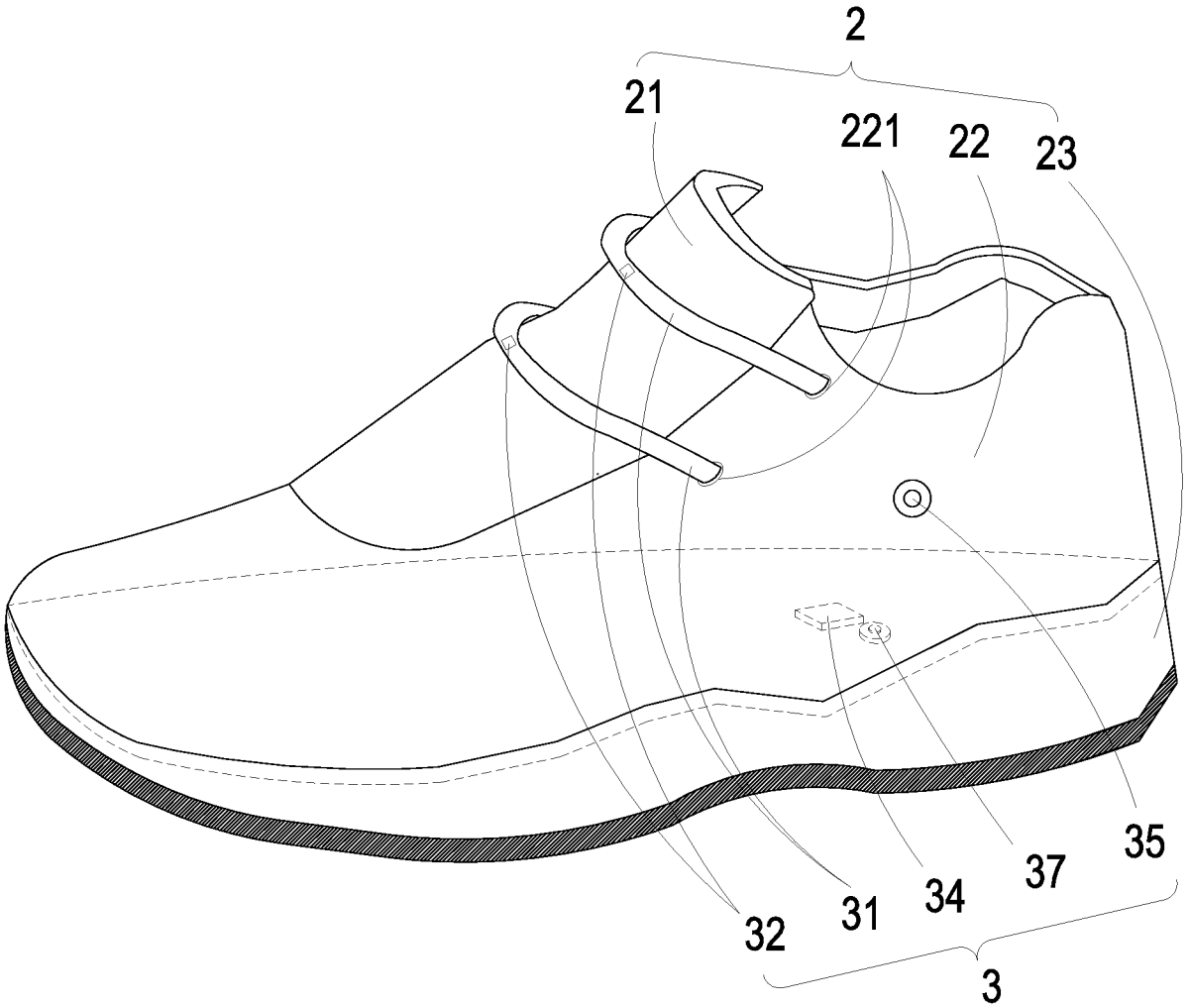
FIG. 10 schematically illustrates the configuration of an inflatable system using a pneumatic elastic band according an embodiment of the present disclosure.
Figure 11:
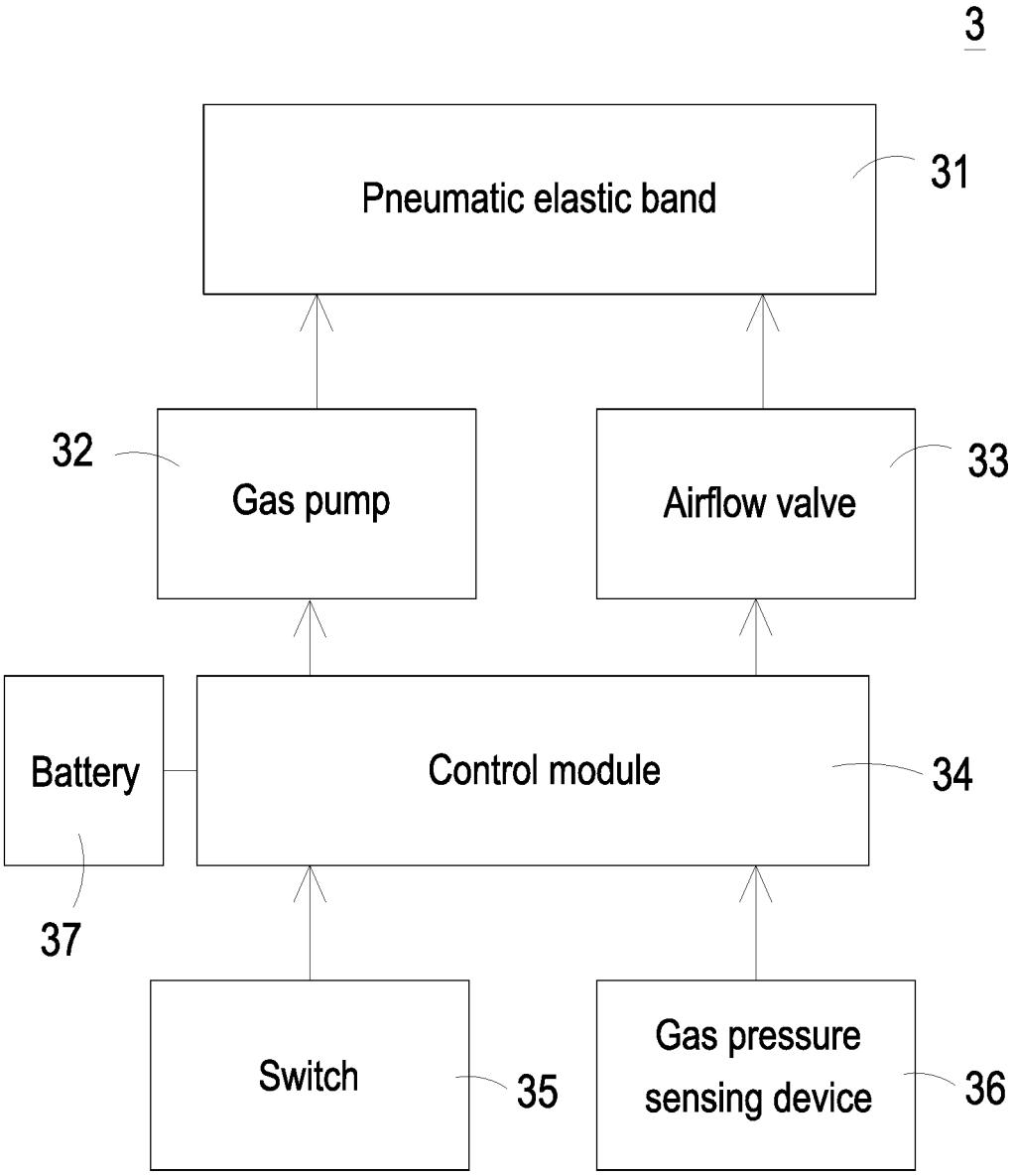
FIG. 11 schematically illustrates the configuration of an inflatable system using a pneumatic elastic band according an embodiment of the present disclosure.

Please simultaneously refer to FIG. 10 and FIG. 11. FIG. 10 schematically illustrates the configuration of an inflatable system using a pneumatic elastic band according an embodiment of the present disclosure. FIG. 11 schematically illustrates the configuration of an inflatable system using a pneumatic elastic band according an embodiment of the present disclosure. As shown in the figures, an inflatable system 3 of the present embodiment is applied to a sport shoe 2. The sport shoe 2 comprises a shoe tongue 21, a shoe body 22 and a bottom part 23. There are a plurality of eyelets 221 symmetrically disposed on two sides the shoe body 22. The structure of the sport shoe 2 is similar to the above-mentioned embodiments so not redundantly described herein. As shown in FIG. 10, an inflatable system 3 of the present embodiment includes a pair of pneumatic elastic bands 31, a pair of gas pumps 32, a control module 34, a switch 35 and a battery 37. The pneumatic elastic bands 31 are also fixed on the eyelets 221 and each of the pneumatic elastic bands 31 includes the outer portion, the inflatable portion and the nozzle (not shown), the structure and disposing method of which are similar to the above-mentioned embodiments and are not redundantly described herein. In this embodiment, the gas pump 32 is an embedded-in gas pump, which is in communication with the nozzle of the pneumatic elastic band 31 for guiding the gas into the inflation portion of the pneumatic elastic band 31, but not limited herein. The structure, the disposing method and the operation of the gas pump 32 are similar to the above-mentioned embodiments and are not redundantly described herein. In some embodiments, the gas pump 32 can also be a detachable gas pump. The switch 35 is disposed on the shoe body 22 of the sport shoe 2, but not limited herein. The switch 35 may be a button or a knob that can be turned on or turned off, but not limited herein. The switch 35 is used for controlling the pneumatic elastic band 31 to be tightened or loosened. The control module 34 of the present embodiment can be but not limited to be disposed on the bottom part 23 of the sport shoe 2. The control module 34 is electrically connected with the gas pump 32, the switch 35 and the battery 37 for transmitting signals and driving electric power. The battery 37 of the present embodiment is used to provide the driving power source to the control module 34 and the elements electrically connected with the control module 34, and it can be but not limited to a mercury battery.

Please continuously refer to FIG. 10 and FIG. 11. In this embodiment, when the switch 35 of the inflatable system 3 is switched on by the user, the switch 35 sends an enable signal to the control module 34, and the control module 34 drives the gas pump 32 to guide the gas from an exterior of the pneumatic elastic band 31 into the inflatable portion according to the enable signal. Thus, the pneumatic elastic band 31 is inflated, so that the pneumatic elastic band 31 contracts inwardly and tightening the sport shoe 2. On the contrary, when the switch 35 is switched off by the user, the switch 35 sends a pressure relief signal to the control module 34, and the control module 34 guides the gas out of the inflatable portion to the exterior of the sport shoe 2 according to the pressure relief signal. Thus, the pneumatic elastic band 31 is deflated and loosened to return to the uninflated state, thereby loosening the sport shoe 2.

Please keep referring to FIG. 11. The inflatable system 3 of the present embodiment further comprises an airflow valve 33. The airflow valve 33 is a valve structure that is able to be opened and closed. It is disposed on the nozzle (not shown) of the pneumatic elastic band 31 for controlling the flow of the gas in and out of the inflatable portion of the pneumatic elastic band 31. The airflow valve 33 is electrically connected with the control module 34 and controlled by the control module 34 to be opened or closed. When the airflow valve 33 is closed, the airflow valve 33 completely seals the nozzle of the pneumatic elastic band 31, thereby avoiding backflow of the gas. On the contrary, when the airflow valve 33 is opened, the nozzle of the pneumatic elastic band 31 is in communication with the gas pump 32 so that the gas pump 32 can introduce the gas into the inflatable portion (not shown) through the nozzle of the pneumatic elastic band 31, but not limited herein.

In addition, the inflatable system 3 of the present embodiment further includes a gas pressure sensing device 36. The gas pressure sensing device 36 is electrically connected with the control module 34 and disposed within the inflatable portion (not shown), but not limited herein, for sensing variation of the gas pressure inside the inflatable portion of the pneumatic elastic band 31. When the gas pressure sensing device 36 senses an inner pressure of the inflatable portion achieving a specific threshold value range, the gas pressure sensing device 36 sends a disable signal to the control module 34, and the control module 34 controls the gas pump 32 to stop operating according to the disable signal, thereby avoiding the rupture of the inflating portion caused by excessive inner pressure thereof. Also, the gas pump 32 is prevented from working too long to break down.

As mentioned above, the inflatable system 3 of the present disclosure uses the control module 34 to control the gas pump 32 and the airflow valve 33, thereby tightening or loosening the pneumatic elastic bands 31 according to the utilization status of the sport shoe 2. Hence, the smart and convenient wearing experiences of the sport shoe 2 are implemented. Furthermore, the inflatable system 3 of the present disclosure uses the gas pressure sensing device 36 and the control module 34 to sense the inner pressure of the pneumatic elastic bands 31, and accordingly controls the inner pressure of the pneumatic elastic band 31 to be maintained in an optimum range. Hence, an optimum degree of tightness of the pneumatic elastic bands 31 is provided, and the problem of damage of the components due to high pressure is avoided. As a result, the comfortable and durable wearing experiences are implemented simultaneously.

From the above discussion, the present disclosure provides a pneumatic elastic band able to contract inwardly when being inflated by the gas pump. When the pneumatic elastic band is inflated, it achieves the same effect as tightening normal shoelaces; whereas when the pneumatic elastic band is deflated, it achieves the same effect as loosening normal shoelaces. The pneumatic elastic bands can tighten the shoe rapidly and not easy to be accidentally loosened during the user is walking. Moreover, as being filled with the gas, the pneumatic elastic bands are elastic like balloons and avoid discomfort made by tightly-tied shoelaces.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pneumatic elastic band, comprising:

an outer portion having a strip-shaped structure with elasticity;

an inflatable portion disposed within the outer portion, the inflatable portion comprising a plurality of expansion portions and a plurality of communication portions, each of the communication portions is connected between two of the expansion portions adjacent to each other for defining a plurality of gaps; and a nozzle disposed on a surface of the outer portion and communicated with the inflatable portion, wherein when a gas is guided into the inflatable portion through the nozzle, the plurality of expansion portions of the inflatable portion are inflated to fill the plurality of gaps and make the inflatable portion contract inwardly, so that the outer portion correspondingly contracts inwardly and deforms, wherein when the gas is guided out of the inflatable portion through the nozzle, the inflatable portion is deflated and loosened to return to an uninflated state.

2. The pneumatic elastic band according to claim 1, wherein the pneumatic elastic band further comprises an airflow valve disposed on the nozzle, the airflow valve controls a flow of the gas in and out of the inflatable portion.

3. The pneumatic elastic band according to claim 1, wherein the pneumatic elastic band further comprises a gas pump, the gas pump is a piezoelectric actuated gas pump communicated with the nozzle.

4. The pneumatic elastic band according to claim 3, wherein the gas pump is a detachable gas pump.

5. The pneumatic elastic band according to claim 3, wherein the gas pump comprises:

a resonance plate having a central aperture, wherein a movable portion of the resonance plate is disposed around the central aperture;

a piezoelectric actuator disposed corresponding to the resonance plate; and a cover plate having at least one sidewall, a bottom plate and an opening portion disposed on the sidewall, wherein the at least one sidewall protrudes from the periphery of the bottom plate to commonly form an accommodation space for accommodating the resonance plate and the piezoelectric actuator, wherein an interval is provided between the resonance plate and the piezoelectric actuator to form a chamber therebetween, so that when the piezoelectric actuator is driven, an airflow is guided in from the opening portion of the cover plate, transferred through the central aperture of the resonance plate and into the chamber, wherein the airflow is transferred by resonance between the piezoelectric actuator and the movable portion of the resonance plate.

6. The pneumatic elastic band according to claim 5, wherein the piezoelectric actuator comprises:

a suspension plate having a first surface and a second surface, wherein the suspension plate is permitted to undergo a bending vibration;

an outer frame disposed around the suspension plate;

at least one bracket connected between the suspension plate and the outer frame to elastically support the suspension plate; and a piezoelectric element having a side length less than or equal to a side length of the suspension plate, and the piezoelectric element is attached on the first surface of the suspension plate, wherein when a voltage is applied to the piezoelectric element, the piezoelectric element drives the suspension plate to undergo the bending vibration.

7. The pneumatic elastic band according to claim 6, wherein the suspension plate is a square-shaped suspension plate having a bulge.

8. The pneumatic elastic band according to claim 7, wherein the piezoelectric actuated gas pump comprises a conducting plate, a first insulation plate and a second insulation plate, wherein the resonance plate, the piezoelectric actuator, the first insulation plate, the conducting plate, the second insulation plate and the cover plate are sequentially stacked to be disposed.

9. The pneumatic elastic band according to claim 8, wherein the piezoelectric actuated gas pump further comprises an inlet plate stacked on and assembled with the resonance plate, the inlet plate comprises a first surface, a second surface, at least on inlet, a central cavity and at least one convergence channel, wherein the at least one inlet penetrates through the first surface and the second surface, the at least one convergence channel is disposed on the second surface and in communication with the at least one inlet, the central cavity is also disposed on the second surface and disposed aligned with the central aperture of the resonance plate, and the central cavity is in communication with the at least one convergence channel, wherein after the gas enters the at least one inlet, the gas is collectively converged to the central cavity by the at least one convergence channel, and the gas is guided into the central aperture of the resonance plate.

10. An inflatable system, comprising:

at least one pneumatic elastic band, comprising:

an outer portion having a strip-shaped structure with elasticity;

an inflatable portion disposed in the outer portion, the inflatable portion comprising a plurality of expansion portions and a plurality of communication portions, each of the communication portions is connected between two of the expansion portions adjacent to each other for defining a plurality of gaps; and a nozzle disposed on a surface of the outer portion and communicated with the inflatable portion, wherein when a gas is guided into the inflatable portion through the nozzle, the plurality of expansion portions of the inflatable portion are inflated to fill the plurality of gaps and make the inflatable portion contract inwardly, so that the outer portion correspondingly contracts inwardly and deforms, wherein when the gas is guided out of the inflatable portion through the nozzle, the inflatable portion is deflated and loosened to return to an uninflated state;

a gas pump in communication with the nozzle;

a switch; and a control module electrically connected with the gas pump and the switch, wherein when the switch is switched on, the switch sends an enable signal to the control module, the control module drives the gas pump to guide the gas from an exterior of the at least one pneumatic elastic band into the inflatable portion according to the enable signal, so that the at least one pneumatic elastic band is inflated and contracts inwardly, wherein when the switch is switched off, the switch sends a pressure relief signal to the control module, the control module guides the gas out from the inflatable portion to the exterior of the pneumatic elastic band according to the pressure relief signal, so that the at least one pneumatic elastic band is deflated and loosened to return to the uninflated state.

11. The inflatable system according to claim 10, wherein the inflatable system further comprises a gas pressure sensing device, the gas pressure sensing device is electrically connected with the control module and disposed within the inflatable portion, when the gas pressure sensing device senses an inner pressure of the inflatable portion achieving a specific threshold value range, the gas pressure sensing device sends a disable signal to the control module, and the control module controls the gas pump to stop operating according to the disable signal.

12. The inflatable system according to claim 10, wherein the inflatable system further comprises an airflow valve disposed on the nozzle of the at least one pneumatic elastic band, the airflow valve controls a flow of the gas in and out of the inflatable portion.

* * * * *